US008535105B1

(12) United States Patent
Pelini

(10) Patent No.: US 8,535,105 B1
(45) Date of Patent: Sep. 17, 2013

(54) INTEGRATED JACK PLATE

(76) Inventor: Mark F. Pelini, Valrico, FL (US)

( * ) Notice: Subject to any disclaimer, the term of this patent is extended or adjusted under 35 U.S.C. 154(b) by 264 days.

(21) Appl. No.: 13/136,586

(22) Filed: Aug. 4, 2011

(51) Int. Cl.
*B63H 5/125* (2006.01)
*B63H 20/08* (2006.01)

(52) U.S. Cl.
USPC ..... 440/61 E

(58) Field of Classification Search
USPC ..... 440/53, 59, 61 R, 63, 61 D, 61 E
See application file for complete search history.

(56) References Cited

U.S. PATENT DOCUMENTS 4,624,438 A * 11/1986 Goodman, Jr. ..... 248/642
5,782,662 A 7/1998 Icenogle
6,132,271 A * 10/2000 Hebert ..... 440/59
6,890,227 B1 * 5/2005 Alby et al. ..... 440/61 R
7,390,231 B1 6/2008 Pelini
7,416,459 B1 8/2008 Pelini
7,513,810 B1 4/2009 Pelini
7,527,539 B1 5/2009 Pelini
8,210,886 B1 * 7/2012 Pelini ..... 440/53

* cited by examiner

*Primary Examiner* — Daniel Venne
(74) *Attorney, Agent, or Firm* — Edward P Dutkiewicz

(57) ABSTRACT

An integrated jack plate, comprising several components, in combination. There is a pair of mirror-configured boat mounting plates, an inner lower boat mounting plate cross member, and an outer lower boat mounting plate cross member. There is also provided, an inner upper boat mounting plate cross member, an outer upper boat mounting plate cross member, and a motor mounting slide plate. There is a hydraulic ram clevis coupled to the motor mounting slide plate and an integrated ram—reservoir—motor unit. Lastly, there is a hydraulic base mount and a travel stop.

15 Claims, 3 Drawing Sheets

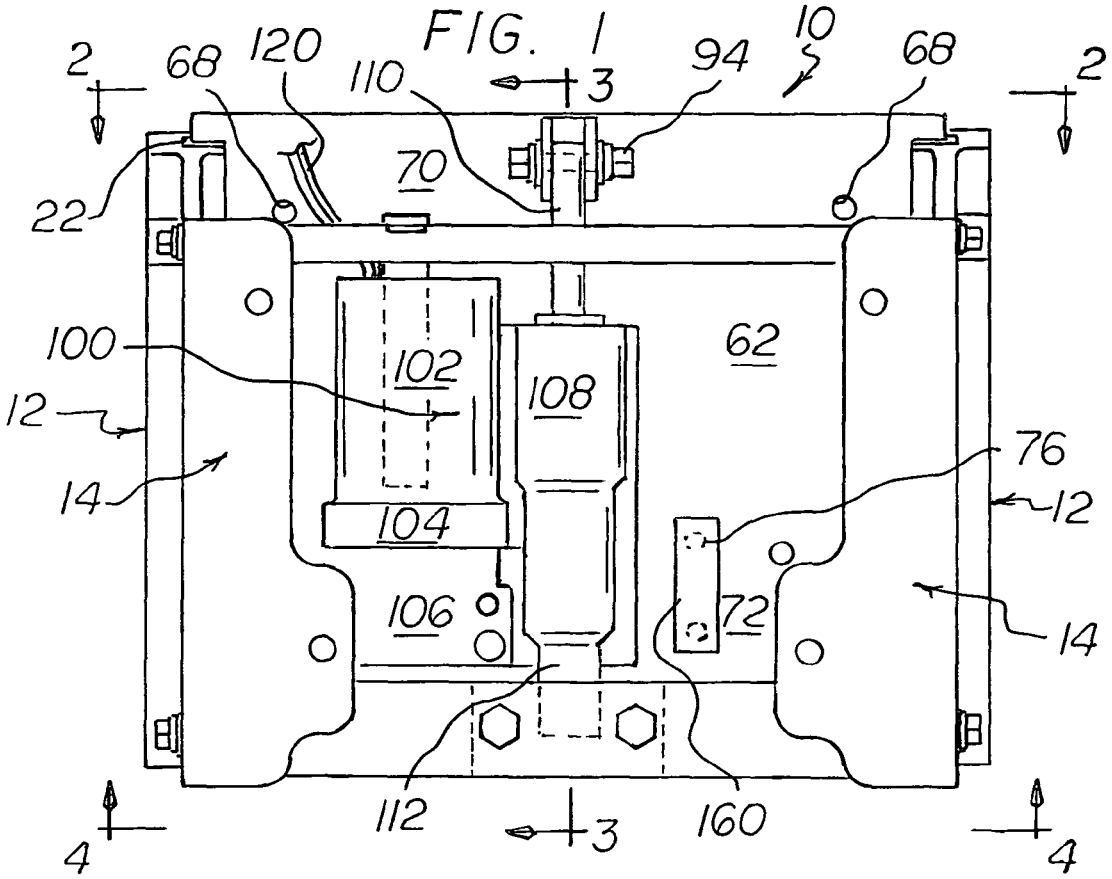
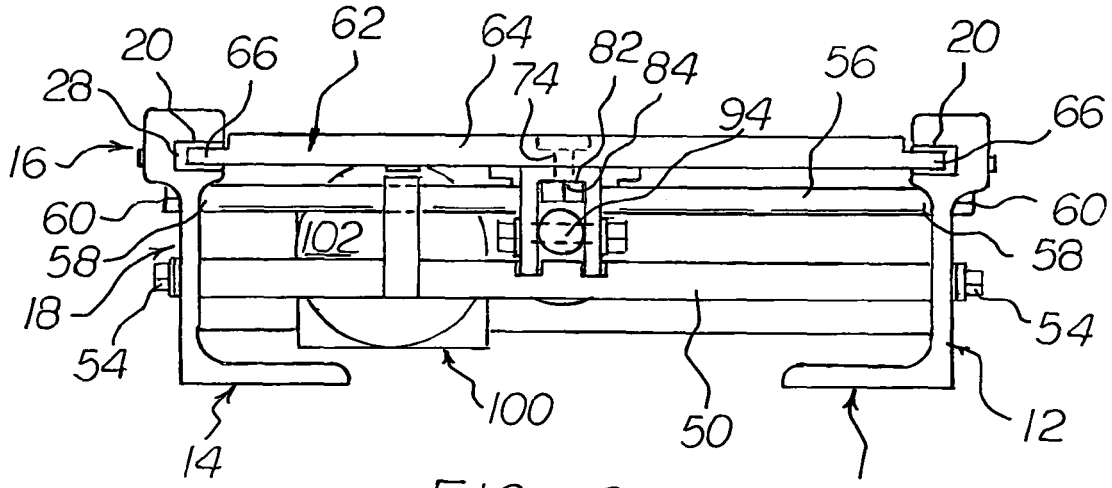
FIG. 2

INTEGRATED JACK PLATE

BACKGROUND OF THE INVENTION

1. Field of the Invention

The present invention relates to an integrated jack plate, and more particularly pertains to an integrated motor, pump, reservoir, and hydraulic cylinder use for the height adjusting of an outboard motor in a safe, convenient and economical manner.

2. Description of the Prior Art

The use of jack plates of known designs and configurations is known in the prior art. More specifically, jack plates of known designs and configurations previously devised and utilized for the purpose of adjusting the height of an outboard motor, through known methods and apparatuses, are known to consist basically of familiar, expected, and obvious structural configurations, notwithstanding the myriad of designs encompassed by the crowded prior art which has been developed for the fulfillment of countless objectives and requirements.

While the prior art devices fulfill their respective, particular objectives and requirements, the prior art patents do not describe an integrated jack plate that allows for a safe economical means of adjusting the operating height of an outboard motor, relative to the transom of a boat, in a safe, convenient and economical manner.

In this respect, the integrated jack plate, according to the present invention, substantially departs from the conventional concepts and designs of the prior art, and in doing so provides a device for the adjusting the operating height of an outboard motor, relative to the transom of a boat, in a safe, convenient and economical manner.

Therefore, it can be appreciated that there exists a continuing need for a new and improved jack plate which can be used for the height adjustment of an outboard motor, in a safe, convenient and economical manner. In this regard, the present invention substantially fulfills this need.

SUMMARY OF THE INVENTION

In view of the foregoing disadvantages inherent in the known types of stop systems of known designs and configurations now present in the prior art, the present invention provides an improved integrated jack plate. As such, the general purpose of the present invention, which will be described subsequently in greater detail, is to provide a new and improved electrically operated jack plate which has all the advantages of the prior art and none of the disadvantages.

To attain this, the present invention essentially comprises an integrated jack plate, comprising several components, in combination.

First there is a pair of mirror-configured boat mounting plates. Each of the boat mounting plates is fabricated of a rigid material, such as aluminum, stainless steel, or steel. Each of the boat mounting plates has a generally L-shaped configuration, with a boat transom mounting portion, a motor mounting portion, and a length therebetween.

The transom mounting portion of each mounting plate is oriented so as to lie generally parallel with a boat transom. The transom mounting portion of each mounting plate forms the lower portion of an L-configuration. Each of the transom mounting portions of the pair of boat mounting plates has a first length. The motor mounting portion of each of the boat mounting plates has a generally C-shaped configuration, with a slide plate retaining groove therein.

The slide plate retaining groove of each of the boat mounting plates has an upper portion and a lower portion. The length of each of the boat mounting plates has a plurality of bolt holes therethrough. Each of the boat mounting plate bolt holes has an associated bolt.

Next there is an inner lower boat mounting plate cross member, which fabricated of rigid material and has a generally rectilinear configuration, with a length, a width, and a thickness. The inner lower boat mounting plate cross member has a pair of opposing ends. Each end of the inner lower boat mounting plate cross member has a threaded bolt hole therein. Each inner lower cross member end threaded bolt hole has an associated inner lower boat mounting plate cross member bolt.

The length of the inner lower boat mounting plate cross member has a centrally located middle portion. The middle portion of the inner lower boat mounting plate cross member has an inner lower cross member recess therein. The inner lower cross member recess has a pair of like-configured bolt holes there in. Each of the inner lower cross member recess bolt holes has an associated bolt.

Next there is an outer lower boat mounting plate cross member which is fabricated of rigid material and has a generally round solid tubular configuration, with a length and a first diameter. The outer lower boat mounting plate cross member has a pair of opposing ends, with each end of the outer lower boat mounting plate cross member having a threaded bolt hole therein. Each outer lower cross member end threaded bolt hole has an associated outer lower boat mounting plate cross member bolt. The outer lower boat mounting plate cross member is located within the lower portion of the groove of each of the boat mounting plates.

Next there is an inner upper boat mounting plate cross member which is fabricated of rigid material and has a generally rectilinear configuration, with a length, a width, and a thickness. The inner upper boat mounting plate cross member has a pair of opposing ends. Each end of the inner upper boat mounting plate cross member has a threaded bolt hole therein. Each inner upper cross member end threaded bolt hole has an associated inner upper boat mounting plate cross member bolt.

Next there is an outer upper boat mounting plate cross member which is fabricated of rigid material and has a generally round solid tubular configuration with a length and a second diameter. The outer upper boat mounting plate cross member has a pair of opposing ends. Each end of the outer upper boat mounting plate cross member has a threaded bolt hole therein. Each outer upper cross member end threaded bolt holes has an associated outer upper boat mounting plate cross member bolt. The outer upper boat mounting plate cross member is located near, and outside of, the upper portion of the groove of each of the boat mounting plates.

Next there is a motor mounting slide plate which is fabricated of a rigid material and has a generally planar rectilinear configuration. The motor mounting slide plate has a motor side, a boat side, and a thickness therebetween.

The thickness forms an upper peripheral edge, a lower peripheral edge, and a pair of like-configured side peripheral edges of the motor mounting plate. The side peripheral edges each have a stepped portion therein. Each stepped portion of the side peripheral edges has an associated nylon insert which fits into the slide plate retaining grooves, as shown in FIG. 2.

The motor mounting slide plate has a plurality of motor mounting bolt holes therethrough. The motor mounting slide plate has a right side and an opposing left side. The right side and the left side of the motor mounting slide plate are each configured to mate with, be accepted by, and retained in, the C-shaped configured slide plate retaining grooves of each of the boat mounting plates.

The motor mounting slide plate has an upper portion and a lower portion. The upper portion of the motor mounting slide plate has a pair of upper hydraulic ram clevis bolt holes therethrough. The lower portion of the motor mounting slide plate has a pair of travel stop bolt holes therethrough.

Next, there is a hydraulic ram clevis. The ram clevis is fabricated of a rigid material and has a generally U-shaped configuration forming a recess therein. The recess has an innermost extent. The innermost extent of the recess has a pair of clevis mounting bolt holes therethrough, with each of the clevis mounting bolt holes having an associated clevis mounting bolt.

The clevis also has a pair of outermost extents. The outermost extents of the U-shape configured clevis form a pair of generally parallel tabs, with each of the tabs having a similarly located and oriented ram pin hole therethrough. The ram pin holes each have an associated ram pin. The ram pins have a generally round solid tubular configuration.

Next, there is an integrated ram—reservoir—motor unit. The ram—reservoir—motor unit is referred to as the RRM unit. The RRM unit has an electric pump motor and an associated pump. The pump and pump motor are operatively coupled to a hydraulic fluid reservoir, with the fluid reservoir being operatively coupled to a hydraulic ram housing and hydraulic ram, thereby forming a single unit.

The hydraulic ram has a base. The hydraulic ram base has a ram base pin hole therethrough. The hydraulic ram base has an associated ram base pin and a pair of associated thrust washers. The pump motor has a pair of wires operatively coupled thereto. The wires are coupled to a power source, such as a battery, for providing power to the pump motor.

There is a hydraulic base mount. The hydraulic base mount has a generally C-shaped configuration. The hydraulic base mount has a cross portion having a generally rectilinear configuration, with a pair of generally parallel extending portions. The cross portion is continuous with each of the pair of extending portions. The base mount has an inner surface, an outer surface, an upper surface, a lower surface, and a pair of generally parallel side surfaces. The upper surface has a base mount recess therein. The side surfaces each have a base mount pin hole therethrough. The base mount pin holes have an associated base mount pin. The outer surface and inner surface of the base mount have a pair of through holes therethrough. The through holes of the base mount each having an associated bolt. The outer surface has a pair of threaded locking pin holes therein. The threaded locking pin holes each communicate with one of the base mount pin holes. Each of the threaded locking pin holes have an associated threaded locking pin.

Lastly, there is a travel stop which is bolted to the slide plate.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several, purposes of the present invention. It is important, therefore, that the claims be regarded as including such equivalent constructions insofar as they do not depart from the spirit and scope of the present invention.

It is therefore an object of the present invention to provide a new and improved integrated jack plate which has all of the advantages of the prior art stop systems of known designs and configurations and none of the disadvantages.

It is another object of the present invention to provide a new and improved integrated jack plate which may be easily and efficiently manufactured and marketed.

It is further object of the present invention to provide a new and improved integrated jack plate which is of durable and reliable constructions.

An even further object of the present invention is to provide a new and improved integrated jack plate which is susceptible of a low cost of manufacture with regard to both materials and labor, and which accordingly is then susceptible of low prices of sale to the consuming public, thereby making such integrated jack plate economically available to the buying public.

Even still another object of the present invention is to provide an integrated jack plate for allowing the user to adjust the height of an outboard motor in a safe, convenient and economical manner.

Lastly, it is an object of the present invention to provide an integrated jack plate, comprising several components, in combination. There is a pair of mirror-configured boat mounting plates, an inner lower boat mounting plate cross member, and an outer lower boat mounting plate cross member. There is also provided, an inner upper boat mounting plate cross member, an outer upper boat mounting plate cross member, and a motor mounting slide plate. There is a hydraulic ram clevis coupled to the motor mounting slide plate and an integrated ram—reservoir—motor unit. Lastly, there is a hydraulic base mount and a travel stop.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the primary and preferred embodiment of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an elevational view from the motor mounting side of the jack plate, also referred to as the outer side.

FIG. 2 is a view taken along line 2-2 of FIG. 1.

The same reference numerals refer to the same parts throughout the various Figures.

DESCRIPTION OF THE PREFERRED EMBODIMENT

Figure 3:
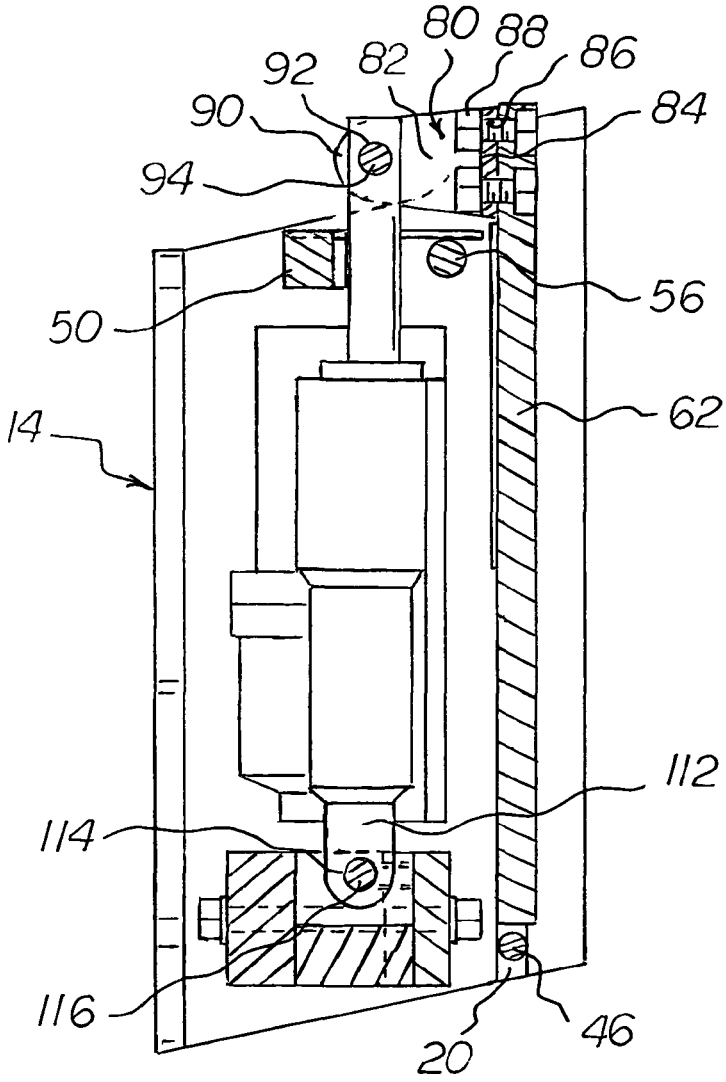
FIG. 3 is a view taken along line 3-3 of FIG. 1.
Figure 4:
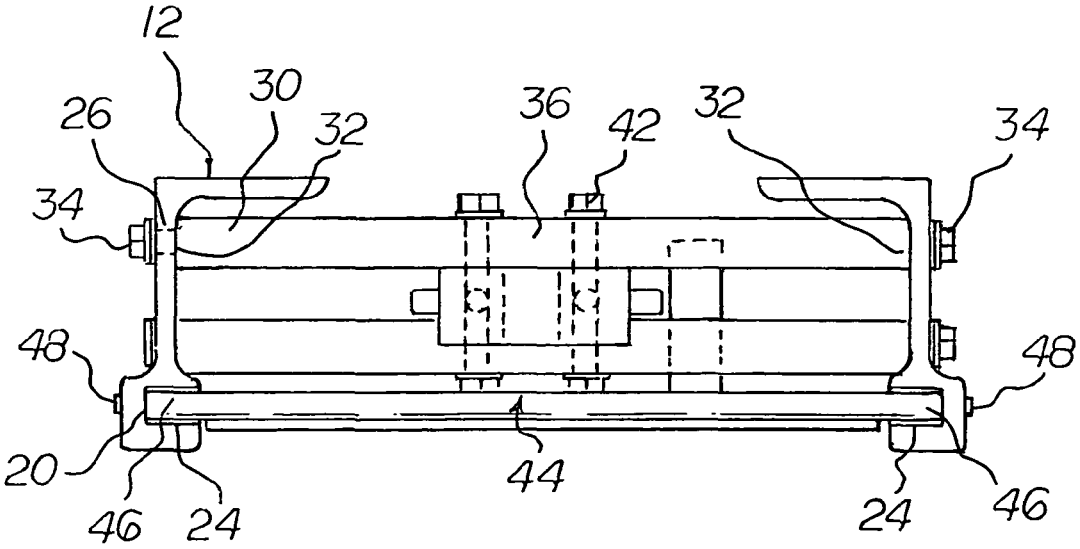
FIG. 4 is a view taken along line 4-4 of FIG. 1.
Figure 5:
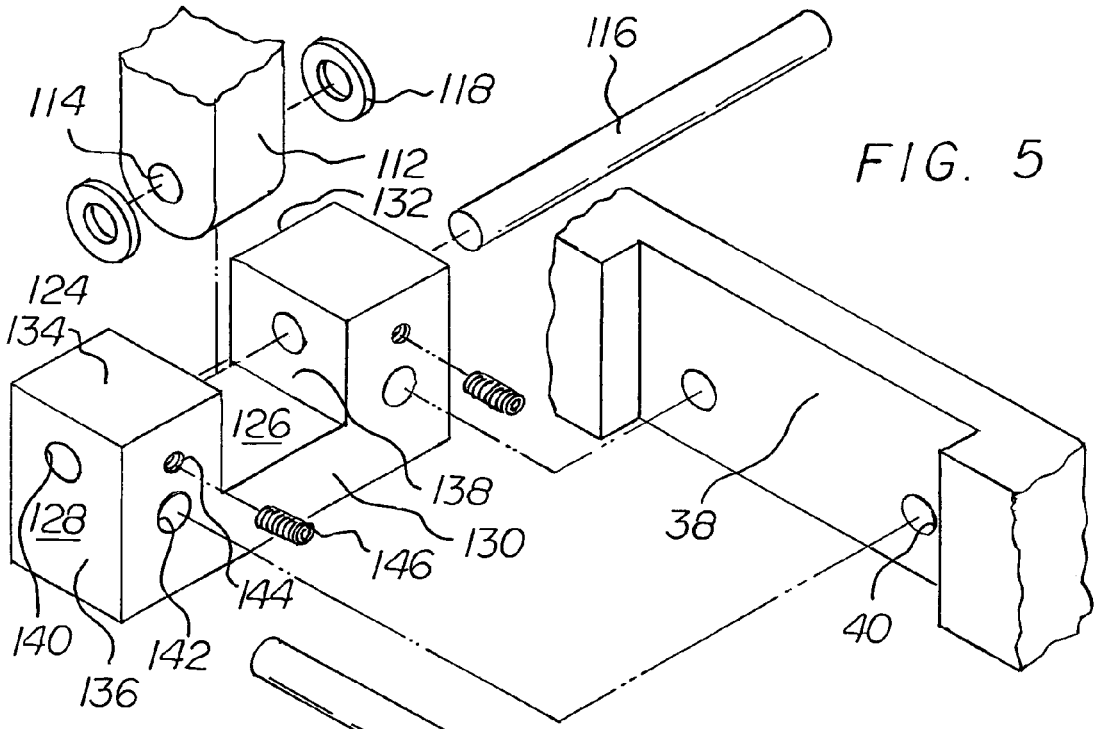
FIG. 5 is an exploded view of the hydraulic base mount.

With reference now to the drawings, and in particular to FIG. 1 thereof, the preferred embodiment of the new and improved integrated jack plate embodying the principles and concepts of the present invention and generally designated by the reference numeral 10 will be described.

To attain this, the present invention essentially comprises an integrated jack plate 10, comprising several components, in combination.

First there is a pair of mirror-configured boat mounting plates 12. Each of the boat mounting plates is fabricated of a rigid material, such as aluminum, stainless steel, or steel. Each of the boat mounting plates has a generally L-shaped configuration, with a boat transom mounting portion 14, a motor mounting portion 16, and a length 18 therebetween.

The transom mounting portion of each mounting plate is oriented so as to lie generally parallel with a boat transom. The transom mounting portion of each mounting plate forms the lower portion of an L-configuration. Each of the transom mounting portions of the pair of boat mounting plates has a first length. The motor mounting portion of each of the boat mounting plates has a generally C-shaped configuration, with a slide plate 20 retaining groove therein.

The slide plate retaining groove of each of the boat mounting plates has an upper portion 22 and a lower portion 24. The length of each of the boat mounting plates has a plurality of bolt holes 26 therethrough. Each of the boat mounting plate bolt holes has an associated bolt.

The slide plate retaining grooves each have an associated nylon insert 28.

Next there is an inner lower boat mounting plate cross member 30, which fabricated of rigid material and has a generally rectilinear configuration, with a length, a width, and a thickness. The inner lower boat mounting plate cross member has a pair of opposing ends 32. Each end of the inner lower boat mounting plate cross member has a threaded bolt hole (not shown) therein. Each inner lower cross member end threaded bolt hole has an associated inner lower boat mounting plate cross member bolt 34.

The length of the inner lower boat mounting plate cross member has a centrally located middle portion 36. The middle portion of the inner lower boat mounting plate cross member has an inner lower cross member recess 38 therein. The inner lower cross member recess has a pair of like-configured bolt holes 40 there in. By "like-configured" is meant that the physical appearance of the bolt holes is generally the same. Each of the inner lower cross member recess bolt holes has an associated bolt 42.

Next there is an outer lower boat mounting plate cross member 44 which is fabricated of rigid material and has a generally round solid tubular configuration, with a length and a first diameter. The outer lower boat mounting plate cross member has a pair of opposing ends 46, with each end of the outer lower boat mounting plate cross member having a threaded bolt hole therein (not shown). Each outer lower cross member end threaded bolt hole has an associated outer lower boat mounting plate cross member bolt 48. The outer lower boat mounting plate cross member is located within the lower portion of the groove of each of the boat mounting plates.

Next there is an inner upper boat mounting plate cross member 50 which is fabricated of rigid material and has a generally rectilinear configuration, with a length, a width, and a thickness. The inner upper boat mounting plate cross member has a pair of opposing ends 52. Each end of the inner upper boat mounting plate cross member has a threaded bolt hole therein (not shown). Each inner upper cross member end threaded bolt hole has an associated inner upper boat mounting plate cross member bolt 54.

Next there is an outer upper boat mounting plate cross member 56 which is fabricated of rigid material and has a generally round solid tubular configuration with a length and a second diameter. The outer upper boat mounting plate cross member has a pair of opposing ends 58. Each end of the outer upper boat mounting plate cross member has a threaded bolt hole therein (not shown). Each outer upper cross member end threaded bolt holes has an associated outer upper boat mounting plate cross member bolt 60. The outer upper boat mounting plate cross member is located near, and outside of, the upper portion of the groove of each of the boat mounting plates.

Next there is a motor mounting slide plate 62 which is fabricated of a rigid material and has a generally planar rectilinear configuration. The motor mounting slide plate has a motor side, a boat side, and a thickness therebetween.

The thickness forms an upper peripheral edge 64, a lower peripheral edge, and a pair of like-configured side peripheral edges of the motor mounting plate. The side peripheral edges each have a stepped portion 66 therein.

The motor mounting slide plate has a plurality of motor mounting bolt holes 68 therethrough. The motor mounting slide plate has a right side and an opposing left side. The right side and the left side of the motor mounting slide plate are each configured to mate with, be accepted by, and retained in, the C-shaped configured slide plate retaining grooves of each of the boat mounting plates.

The motor mounting slide plate has an upper portion 70 and a lower portion 72. The upper portion of the motor mounting slide plate has a pair of upper hydraulic ram clevis bolt holes 74 therethrough. The lower portion of the motor mounting slide plate has a pair of travel stop bolt holes 76 therethrough.

Next, there is a hydraulic ram clevis 80. The ram clevis is fabricated of a rigid material and has a generally U-shaped configuration forming a recess 82 therein. The recess has an innermost extent 84. The innermost extent of the recess has a pair of clevis mounting bolt holes 86 therethrough, with each of the clevis mounting bolt holes having an associated clevis mounting bolt 88.

The clevis also has a pair of outermost extents 90. The outermost extents of the U-shape configured clevis form a pair of generally parallel tabs, with each of the tabs having a similarly located and oriented ram pin hole 92 therethrough. By "similarly located" is meant that the location of the pin hole is generally in the same location relative to the structure the pin hole is in. The ram pin holes each have an associated ram pin 94. The ram pins have a generally round solid tubular configuration.

Next, there is an integrated ram—reservoir—motor unit 100. The ram—reservoir—motor unit is referred to as the RRM unit. The RRM unit has an electric pump motor 102 and an associated pump 104. The pump and pump motor are operatively coupled to a hydraulic fluid reservoir 106, with the fluid reservoir being operatively coupled to a hydraulic ram housing 108 and hydraulic ram 110, thereby forming a single unit.

The hydraulic ram has a base 112. The hydraulic ram base has a ram base pin hole 114 therethrough. The hydraulic ram base has an associated ram base pin 116 and a pair of associated thrust washers 118. The pump motor has a pair of wires 120 operatively coupled thereto. The wires are coupled to a power source, such as a battery, for providing power to the pump motor (not shown, but well known in the art).

There is a hydraulic base mount 124. The hydraulic base mount has a generally C-shaped configuration. The hydraulic base mount has a cross portion 126 having a generally rectilinear configuration, with a pair of generally parallel extending portions 128. The cross portion is continuous with each of the pair of extending portions. The base mount has an inner surface 130, an outer surface 132, an upper surface 134, a lower surface, and a pair of generally parallel side surfaces 136. The upper surface has a base mount recess 138 therein. The side surfaces each have a base mount pin hole 140 therethrough. The base mount pin holes have an associated base mount pin, which is the ram base pin 116. The outer surface and inner surface of the base mount have a pair of through holes 142 therethrough. The through holes of the base mount each having an associated bolt (not shown). The outer surface has a pair of threaded locking pin holes 144 therein. The threaded locking pin holes each communicate with one of the base mount pin holes. Each of the threaded locking pin holes have an associated threaded locking pin 146.

Figure 6:
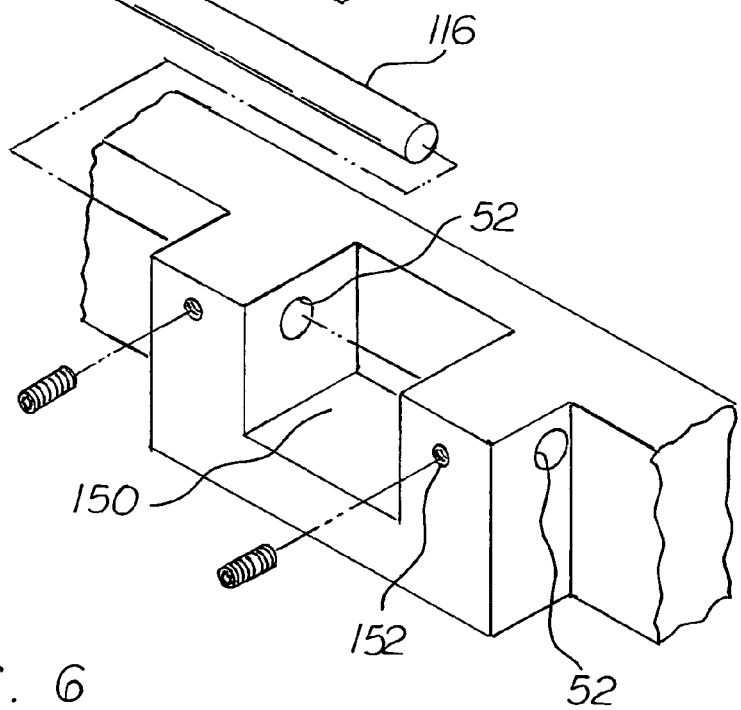
FIG. 6 is an exploded view of a variation of the hydraulic base mount, wherein the base mount and the inner lower boat mounting plate cross member are made of one piece, and are therefore, continuous.

In a variation of the hydraulic base mount, the mount may be continuous with the lower inner cross member, as shown in FIG. 6. There is a recess 150 with a pair of locking pin holes 152. There are a pair of base mount pin holes therethrough, with the base pin 116 being used to secure the hydraulic base to the base mount.

In another variation of the hydraulic base mount, the through hole 142 does not run through the entire mount, but rather forms a hole through one side, and a partial hole through the other side of the base mount. This configuration would be considered a "partial hole", and will be referred to as such. In this configuration, there may be only one base mount pin hole, and only one base mount pin associated therewith.

Lastly, there is a travel stop 160, which is bolted to the slide plate.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An integrated jack plate, comprising, in combination:

a pair of mirror-configured boat mounting plates having a generally L-shaped configuration with a boat transom mounting portion and a motor mounting portion with a length therebetween, the motor mounting portion of each of the boat mounting plates having a generally C-shaped configuration with a slide plate retaining groove therein, the slide plate retaining groove of each of the boat mounting plates having an upper portion and a lower portion;

an inner lower boat mounting plate cross member having a centrally located middle portion, with the middle portion of the inner lower boat mounting plate cross member having an inner lower cross member recess therein, with the inner lower cross member recess having a pair of bolt holes there in, with each of the inner lower cross member recess bolt holes having an associated bolt, the inner lower boat mounting plate cross member being coupled to each of the boat mounting plates;

an outer lower boat mounting plate cross member being coupled to each of the boat mounting plates;

an inner upper boat mounting plate cross member being coupled to each of the boat mounting plates;

an outer upper boat mounting plate cross member being coupled to each of the boat mounting plates;

a motor mounting slide plate having a generally planar rectilinear configuration with a motor side and a boat side and a thickness therebetween, the thickness forming an upper peripheral edge and a lower peripheral edge and a pair of like configured side peripheral edges of the motor mounting plate;

a hydraulic ram clevis having a being operatively coupled to the motor mounting slide plate;

an integrated ram—reservoir—motor unit having an electric pump motor and an associated pump, the pump and pump motor being operatively coupled to a hydraulic fluid reservoir with the fluid reservoir being operatively coupled to a hydraulic ram housing and hydraulic ram, the hydraulic ram having a base, with the hydraulic ram base having a ram base pin hole therethrough, the integrated unit being coupling the lower inner cross member and the slide plate; and a hydraulic base mount having a generally C-shaped configuration with a cross portion having a generally rectilinear configuration with a pair of generally parallel extending portions with the cross portion being continuous with each of the pair of extending portions, the base mount having an inner surface and an outer surface and an upper surface and a lower surface and a pair of generally parallel side surfaces, the upper surface having a base mount recess therein, the base mount being coupled to the lower inner cross member.

2. The integrated jack plate as described in claim 1, with the integrated jack plate further comprising:

the transom mounting portion of each mounting plate being oriented so as to lie generally parallel with a boat transom, the transom mounting portion of each mounting plate forming the lower portion of the L-configuration;

the motor mounting slide plate having an upper portion and a lower portion with the upper portion of the motor mounting slide plate having a pair of upper hydraulic ram clevis bolt holes therethrough and the lower portion of the motor mounting slide plate having a pair of travel stop bolt holes therethrough;

the clevis having generally U-shaped configuration thereby forming a recess therein, the innermost extent of the recess having a pair of clevis mounting bolt holes therethrough with each of the clevis mounting bolt holes having an associated clevis mounting bolt, the clevis;

the hydraulic ram base having a ram base pin hole therethrough, the hydraulic ram base having an associated ram base pin and a pair of associated thrust washers, the pump motor having a pair of wires operatively coupled thereto, with the wires being coupled to a power source for providing power to the pump motor; and the hydraulic base mount side surfaces each having a base mount pin hole therethrough with the base mount pin holes having an associated base mount pin.

3. The integrated jack plate as described in claim 2, with the integrated jack plate further comprising:

the outer lower boat mounting plate cross member having a generally round solid tubular configuration with a length and a first diameter;

the outer upper boat mounting plate cross member having a generally round solid tubular configuration with a length and a second diameter;

the outer most extents of the U-shape configured clevis forming a pair of generally parallel tabs; and the outer surface and inner surface of the base mount having a pair of through holes therethrough, with the through holes each having an associated bolt.

4. The integrated jack plate as described in claim 3, with the integrated jack plate further comprising:

the inner lower boat mounting plate cross member having a generally rectilinear configuration with a length and a width and a thickness, the inner lower boat mounting plate cross member having a pair of opposing ends;

the inner upper boat mounting plate cross member having a generally rectilinear configuration with a length and a width and a thickness, the inner upper boat mounting plate cross member having a pair of opposing ends;

the motor mounting slide plate side peripheral edges each having a stepped portion therein, the motor mounting slide plate having a right side and an opposing left side with the right side and the left side of the motor mounting slide plate being configured to mate with and be accepted by and retained in the C-shaped configured slide plate retaining grooves of each of the boat mounting plates;

the ram pin having a generally round solid tubular configuration;

each of the tabs of the clevis having a ram pin hole therethrough, with the ram pin holes having an associated ram pin; and the outer surface of the base mount having a pair of threaded locking pin holes therein, with the threaded locking pin holes each communicating with one of the base mount pin holes, with each of the threaded locking pin holes having an associated threaded locking pin.

5. The integrated jack plate as described in claim 4, with the integrated jack plate further comprising:

the outer lower boat mounting plate cross member having a pair of opposing ends, with each end of the outer lower boat mounting plate cross member having a threaded bolt hole therein, with each outer lower cross member end threaded bolt hole having an associated outer lower boat mounting plate cross member bolt, with each of the outer lower cross member recess bolt holes having an associated bolt; and the outer upper boat mounting plate cross member having a pair of opposing ends, with each end of the outer upper boat mounting plate cross member having a threaded bolt hole therein, with each outer upper cross member end threaded bolt holes having an associated outer upper boat mounting plate cross member bolt, the outer upper boat mounting plate cross member being located near the upper portion of the groove of each of the boat mounting plates.

6. The integrated jack plate as described in claim 5, with the integrated jack plate further comprising:

each of the transom mounting portions of the pair of boat mounting plates having a first length, the length of each of the boat mounting plates having a plurality of bolt holes therethrough, with each of the boat mounting plate bolt holes having an associated bolt the outer lower boat mounting plate cross member being located within the lower portion of the retaining groove of each of the boat mounting plates;

the stepped portion of the motor mounting slide plate side peripheral edges each having an associated nylon insert, with the insert being located within the retaining groove of each of the boat mounting plates.

7. The integrated jack plate as described in claim 6, with the integrated jack plate further comprising:

each end of the inner lower boat mounting plate cross member having a threaded bolt hole therein, with each inner lower cross member end threaded bolt hole having an associated inner lower boat mounting plate cross member bolt;

each end of the inner upper boat mounting plate cross member having a threaded bolt hole therein, with each inner upper cross member end threaded bolt hole having an associated inner upper boat mounting plate cross member bolt; and the motor mounting slide plate having a plurality of motor mounting bolt holes there therethrough.

8. The integrated jack plate as described in claim 7, with the integrated jack plate further comprising:

each of the boat mounting plates being fabricated of a rigid material;

the inner lower boat mounting plate cross member being fabricated of rigid material;

the outer lower boat mounting plate cross member being fabricated of rigid material;

the inner upper boat mounting plate cross member fabricated of rigid material;

the outer upper boat mounting plate cross member fabricated of rigid material;

the motor mounting slide plate fabricated of a rigid material; and hydraulic ram clevis fabricated of a rigid material.

9. An integrated jack plate, comprising, in combination:

a pair of mirror-configured boat mounting plates with each mounting plate having a slide plate retaining groove therein;

an inner lower boat mounting plate cross member being coupled to each of the boat mounting plates;

a motor mounting slide plate having a generally planar rectilinear configuration with a motor side and a boat side and a thickness therebetween, the thickness forming an upper peripheral edge and a lower peripheral edge and a pair of side peripheral edges of the motor mounting plate, the motor mounting slide plate being coupled with each of the boat mounting plates;

a hydraulic ram clevis having a being operatively coupled to the motor mounting slide plate;

a hydraulic base mount having a cross portion having a generally rectilinear configuration with a pair of generally parallel extending portions with the base mount having an inner surface and an outer surface and an upper surface and a lower surface and a pair of generally parallel side surfaces, the upper surface having a base mount recess therein, the base mount being coupled to the inner lower cross member recess; and an integrated ram—reservoir—motor unit having an electric pump motor and an associated pump, the integrated unit coupling the inner lower boat mounting cross member and the motor mounting slide plate.

10. The integrated jack plate as described in claim 9, with the integrated jack plate further comprising:

the boat mounting plates each having a generally L-shaped configuration with a boat transom mounting portion and a motor mounting portion with a length therebetween; and the inner lower mounting plate cross member having a centrally located middle portion, with the middle portion of the inner lower boat mounting plate cross member having an inner lower cross member recess therein.

11. The integrated jack plate as described in claim 10, with the integrated jack plate further comprising:

the motor mounting portion of each of the boat mounting plates having a generally C-shaped configuration thereby forming with the slide plate retaining groove therein;

the electric pump motor and associated pump being operatively coupled to a hydraulic fluid reservoir with the fluid reservoir being operatively coupled to a hydraulic ram housing and hydraulic ram, the hydraulic ram having a base, with the hydraulic ram base having a ram base pin hole therethrough; and the boat mounting plates each having an upper portion and a lower portion.

12. The integrated jack plate as described in claim 11, with the integrated jack plate further comprising:

an outer lower boat mounting plate cross member being coupled to each of the boat mounting plates;

an inner upper boat mounting plate cross member being coupled to each of the boat mounting plates;

an outer upper boat mounting plate cross member being coupled to each of the boat mounting plates;

the hydraulic base mount having a generally C-shaped configuration;

the hydraulic base mount cross portion being continuous with each of the pair of hydraulic base mount extending portions; and the inner lower boat mounting plate cross member recess having a pair of bolt holes there in, with each of the inner lower cross member recess bolt holes having an associated bolt.

13. The integrated jack plate as described in claim 9, with the integrated jack plate further comprising;

the hydraulic base mount and the inner lower boat mounting plate cross member being continuous; and a travel stop being coupled to the slide plate.

14. The integrated jack plate as described in claim 9, with the integrated jack plate further comprising the hydraulic base mount having at least a partial hole therein for receiving a ram base pin.

15. The integrated jack plate as described in claim 13, with the integrated jack plate further comprising the hydraulic base mount having at least a partial hole therein for receiving a ram base pin.

* * * * *